United States Patent [19]

Robert

[11] Patent Number: 4,569,507

[45] Date of Patent: Feb. 11, 1986

[54] TRACTION BLOCK FOR LINEAR WINCH

[75] Inventor: Brieuc Robert, Nanterre, France

[73] Assignee: Kley France, Nanterre, France

[21] Appl. No.: 675,325

[22] Filed: Nov. 27, 1984

[51] Int. Cl.[4] ..... B66D 3/02

[52] U.S. Cl. ..... 254/246; 24/136 R; 254/384

[58] Field of Search ..... 254/264, 384, 402, 245, 254/246, 259; 24/115 M, 132 WL, 136 R; 226/165, 166

[56] References Cited

U.S. PATENT DOCUMENTS

| | | | |
|---|---|---|---|
| 1,146,801 | 7/1915 | Klein et al. | 24/136 R |
| 2,400,514 | 5/1946 | Kantner | 24/136 R |
| 3,758,922 | 9/1973 | Field | 24/115 M |
| 4,068,608 | 1/1978 | Hartz | 24/136 R X |

FOREIGN PATENT DOCUMENTS

| | | | |
|---|---|---|---|
| 0057622 | 11/1982 | European Pat. Off. | 254/384 |
| 405524 | 12/1922 | Fed. Rep. of Germany | 24/115 M |
| 13230 | 7/1916 | United Kingdom | 24/136 R |

*Primary Examiner*—Stuart S. Levy
*Assistant Examiner*—Katherine Jaekel

[57] ABSTRACT

A traction block is provided comprising an elongate frame with U shaped cross section having a flat web and two spaced apart lateral flanges perpendicular to the web, two clamping blocks of elongate shape which are mounted for movement between the lateral flanges of the frame so that a relative longitudinal movement between each movable clamping block and the adjacent flange of the frame causes a transverse movement of the respective movable clamping block, and a flat cover plate parallel to the web of the frame and detachably fixed thereto, said lateral flanges of the frame being provided with tenons which project from their end faces facing towards the cover plate and which are tightly fitted in corresponding cavities in the cover plate.

4 Claims, 4 Drawing Figures

"PRIOR ART"

"PRIOR ART"

TRACTION BLOCK FOR LINEAR WINCH

BACKGROUND OF THE INVENTION

1. Field of the Invention

The present invention relates to a traction block for a linear winch of the type comprising an elongate frame having a U shaped cross section having a flat web and two lateral spaced apart flanges perpendicular to the web, two clamping blocks of elongate shape, which are mounted for movement between the lateral flanges of the frame so that a relative longitudinal movement between each movable clamping block and the adjacent flange of the frame causes a transverse movement of the respective movable clamping block, and a flat cover plate parallel to the web of the frame and fixed removably thereto.

2. Description of the Prior Art

Linear winches are well known apparatus for exerting a pull on a cable, a bar or other elongated traction means, for example for moving a heavy load horizontally or vertically. A linear winch usually comprises two traction blocks which alternately clamp the cable, a first one of the two traction blocks being usued for pulling the cable while said cable slides between the clamping blocks of the second traction block, and the latter being used for holding the cable while the first traction block is brought back to its starting position.

In the prior traction blocks manufactured by the applicant (see for example European patent No. 0 057 622) and one embodiment of which is shown in FIG. 1 of the accompanying drawings, the web 2 of frame 1 is formed by a metal plate and the flanges 3 of the frame are formed by bearing blocks. Each bearing block 3 comprises on its inner face a roller track 4 on which one of the two movable clamping blocks 5 may roll through a plurality of rollers 6. Each roller track 4 forms an angle with the longitudinal axis of the traction block, i.e. with the longitudinal axis of the cable, of the bar or other traction means 7 on which the traction block is intended to act, the roller tracks 4 of the two bearing blocks 3 converging towards one of the two ends of the traction block and each movable clamping block 5 having the shape of a wedge having an apex angle which is equal to the angle formed between the adjacent roller track 4 and the longitudinal axis of the traction block. The cover plate 8 is formed by a plate similar to plate 2 of frame 1. Plate 2, the two bearing blocks 3 and the cover plate 8 are held assembled by two series of stud bolts 9, the stud bolts 9 of one of the two series passing through holes provided in one of the two bearing blocks 3, whereas the stud bolts 9 of the other series pass through holes provided in the other bearing block 3 (a single stud bolt of each series is shown in FIG. 1).

In use, when the movable clamping blocks 5 clamp cable 7, each of the two bearing blocks 3 is subjected, by reaction, to a very considerable force in the direction of arrow $F_1$ or in the direction of arrow $F_2$ depending on the bearing block 3 considered. By way of example, if the pitch of each roller track 4 is 10%, each bearing block 3 is subjected to a force which is equal to about five times the traction force of the linear winch, i.e. for example 300 tons for a traction force of 60 tons. The addition to their assembling role, stud bolts 9 must also be capable of withstanding such a high transverse force. That is why, in the embodiment shown in FIG. 1, a relatively large number of assembling stud bolts 9 must be associated with each bearing block 3, usually 6 to 10 stud bolts depending on the power of the linear winch, i.e. a total of 12 to 20 stud for each traction block.

Now, in use it is desirable for the cover plate 8 of each of the two traction blocks of the linear winch to be able to be easily and rapidly removed for withdrawing or moving the movable clamping block sufficiently aside for setting the traction blocks of the linear winch on the cable 7 at any point thereof without having to thread a long length of the cable between the movable clamping blocks 5. That is also the case when cable 7 is formed from two or more cable sections joined end to end by joining means and when it is desired to pass a joining means through one of the traction blocks while the cable is held under tension by the other traction block.

It is clear that, in the case of the embodiment shown in FIG. 1, for removing cover plate 8 all the stud bolts 9, usually 12 to 20 stud bolts, must be unscrewed which complicates removal of cover plate 8.

In FIG. 2 of the accompanying drawings another embodiment of a prior art traction block is shown. In FIG. 2, the elements which are identical or which play the same role as in FIG. 1 are designated by the same reference numbers. In the embodiment shown in FIG. 2, the cover plate 8 is in the form of a massive piece which may slide in the longitudinal direction with respect to the bearing blocks 3 of frame 1. One or more pins 11 prevent cover plate 8 from sliding with respect to the bearing blocks 3 during use. In use, the pin or pins 11 are not subjected to any transverse force. At the outside, a single pin would be sufficient for locking cover plate 8 with respect to the bearing blocks 3. In the embodiment shown in FIG. 2, cover plate 8 may be easily and rapidly removed since it is sufficient to remove one or a small number of pins 11 and to slide cover 8 longitudinally with respect to the bearing blocks 3. However, in this embodiment, the transverse forces (in the direction of arrows $F_1$ and $F_2$) which, in use, are applied by reaction to the bearing blocks 3, are absorbed by the lateral flange **8*a* of cover plate 8. The result is that the junction zones 8*b* between the lateral flanges 8*a* and part 8*c* of cover plate 8 are subjected to very high moments of flexure. Consequently, cover plate 8 must be a thick and solid piece. By way of comparison, for a linear winch having a traction force of 60 tons, cover plate 8 of the traction block of FIG. 2 has a thickness of 90 mm and a weight of about 280 kg, whereas cover plate 8 of the traction block of FIG. 1** has a thickness of about 40 mm and a weight of about 95 kg.

SUMMARY OF THE INVENTION

The object of the present invention is to provide a traction block the cover plate of which may be easily and rapidly removed, while having a thickness and a weight of the same order as that of the traction block shown in FIG. 1.

To this end, the traction block of the invention is characterized in that the lateral flanges of the frame are provided with tenons which project from the end faces of said lateral flanges facing towards the cover plate and which are tightly fitted into corresponding cavities in the cover plate.

Thus, the above mentioned transverse forces are not absorbed by the assembling stud bolts but by the tenons, so that a small number of bolts is sufficient for assembling the cover plate to the frame.

In an advantageous embodiment of the present invention, the cover plate may be mounted pivotally with respect to the frame. In this case, the tenons of the lateral flanges and the cavities of the cover plate are of conical shape for allowing engagement of the tenons into the cavities of the cover plate during closure thereof and for allowing disengagement of the tenons during opening of the cover plate.

BRIEF DESCRIPTION OF THE DRAWINGS

The invention will be better understood from the following description of an embodiment thereof with reference to the accompanying drawings in which.

DESCRIPTION OF THE PREFERRED EMBODIMENT

Figure 1:
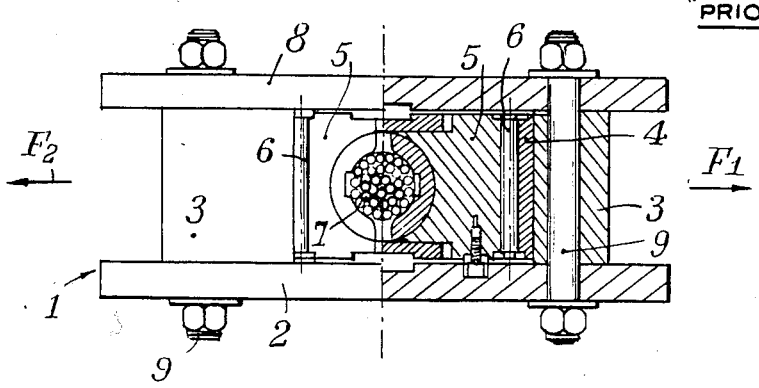
FIG. 1 shows a known traction block half in an end view and half in cross section.
Figure 2:
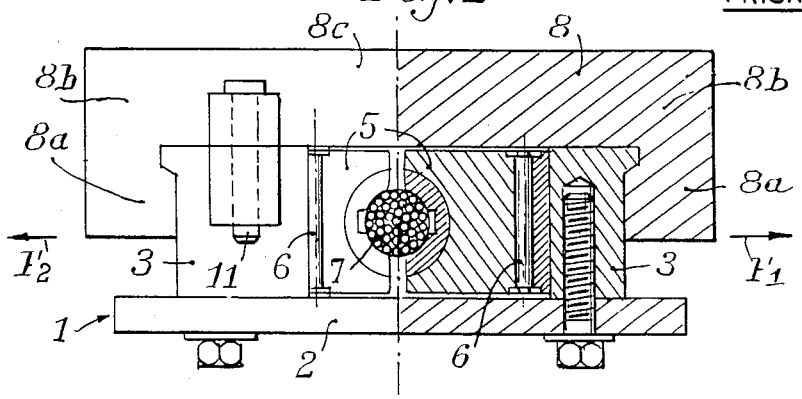
FIG. 2 is a view similar to FIG. 1 showing another known traction block.

The traction blocks shown in FIGS. 1 and 2 will not be described again in detail since they were described earlier.

Figure 4:
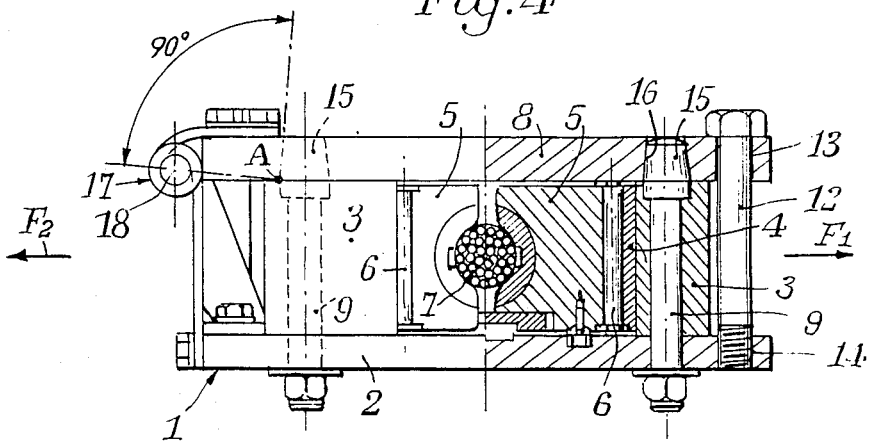
FIG. 4 is a view similar to FIGS. 1 and 2, showing the traction block of FIG. 3 with the cover plate closed.
Figure 3:
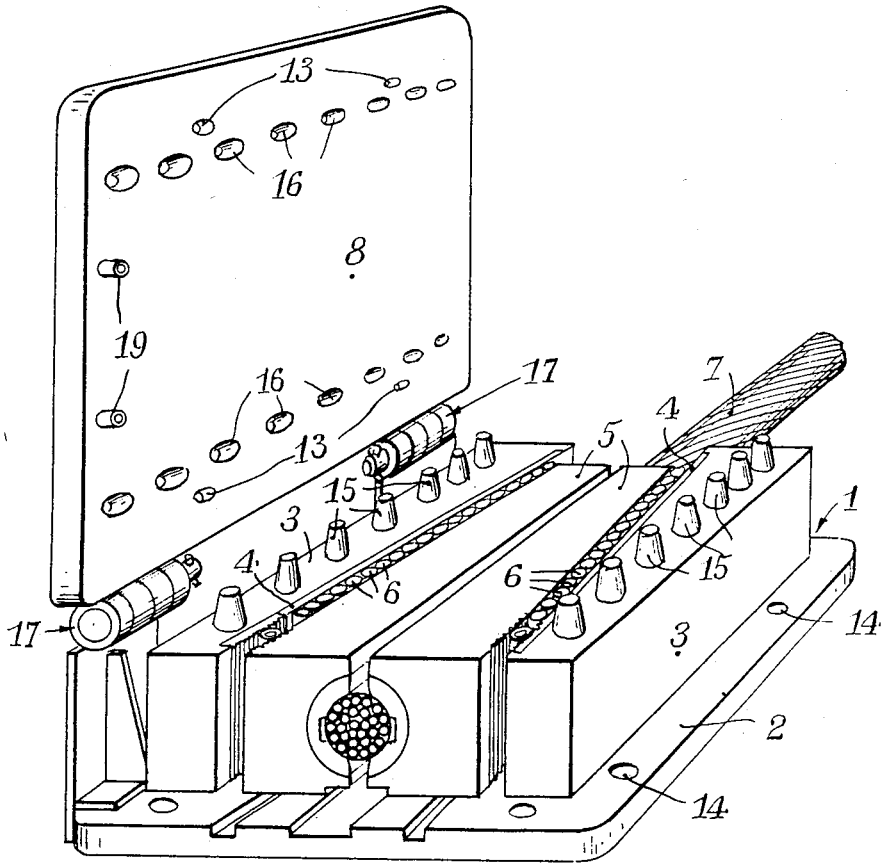
FIG. 3 is a perspective view showing the traction block of the present invention, its cover plate being in an open position.

The traction block shown in FIGS. 3 and 4 comprises, as the traction block of FIG. 1, a frame 1 having a U shaped cross section formed from plate 2 and two bearing blocks 3 between which are located two movable wedge shaped clamping blocks 5. Each clamping block 5 may roll over a roller track 4 of the adjacent bearing block 3 through a series of rollers 6. The roller tracks 4 of the two bearing blocks 3 converge towards one end of the traction blocks so that a longitudinal movement of frame 1 in one direction causes a transverse movement of the clamping blocks 5 one towards the other for clamping the cable or other traction means 7, thus allowing a pull to be exerted thereon, whereas a longitudinal movement of frame 1 in the opposite direction causes the clamping force on blocks 5 and on cable 7 to be released.

In the traction block shown in FIGS. 3 and 4, as in the traction block shown in FIG. 1, frame 1 is completed by a cover plate 8 which contributes to the mechanical rigidity of frame 1, in particular for withstanding transverse forces which are exerted by reaction, during clamping, on the bearing blocks 3 as shown by arrows $F_1$ and $F_2$ in FIG. 4.

As opposed to the traction block of FIG. 1, the stud bolts 9 of the traction block of FIG. 4 do not serve for securing cover plate 8 to frame 1, such fixing being provided by four bolts 12 which pass freely with a small clearance through holes 13 in cover plate 8, outside the two bearing blocks 3 and which are screwed into threaded holes 14 in plate 2 of frame 1. Stud bolts 9 serve solely for fixing the bearing blocks 3 to the plate 2 of the frame.

As best shown in FIG. 3, each bearing block 3 comprises a series of tenons 15 which project from its lateral face facing towards cover plate 8 and which are engageable with a close fit in corresponding cavities 16 in the cover plate 8. Thus, the transverse forces applied to the bearing blocks 3 during clamping are transmitted to cover plate 8 by the tenons 15, without these transverse forces being applied to bolts 12 which solely provide fixing of the cover plate to frame 1. The number and cross section of tenons 15 are of course chosen so as to be able to withstand the above mentioned transverse forces. The number of tenons 15 may be equal to the number of stud bolts 9 and the tenons may be advantageously formed by the heads of stud bolts 9, said heads being so arranged to project beyond the lateral face of the bearing blocks 3 facing towards cover plate 8. Since bolts 12 no longer have to withstand the transverse forces to which the bearing blocks 3 are subjected, their number may be substantially less than the number of stud bolts 9. For example, four bolts 12 may be provided. Thus, cover plate 8 can be easily and rapidly removed simply by unscrewing a small number of bolts 12 and by raising said cover plate 8 so as to disengage it from the tenons 15.

As shown in FIGS. 3 and 4, cover plate 8 may be advantageously mounted pivotally on frame 1 by means of two hinges 17 situated on one side of the traction block. In this case, for allowing engagement and disengagement of the tenons 15 into and out of the cavities 15 of the cover plate 8, the tenons 15 and the cavities 16 are tapered and the axis 18 of hinges 17 is in a plane which contains point A, which is the closest to hinge 17 at the major base of the conical tenon 15, and which is perpendicular to the generatrix of the conical tenon passing through point A as shown in FIG. 4.

Two stops 19 (FIG. 3) project from the lower face of cover plate 8 so that, when said cover plate is closed during use, the clamping blocks 5 cannot escape from the traction block.

It should of course be understood that the above-described embodiment of the present invention has been given purely by way of example and is in no wise limitative, and that numerous modifications may be readily made by a man skilled in the art without departing from the scope and spirit of the present invention. Thus, more particularly, tenons 15 may be formed by elements separate from stud bolts 9, tenons 15 being fixed on one side of the bearing blocks 3 and stud bolts 9 being replaced by bolts which are screwed into tapped holes provided in the opposite side of the bearing block 3. Furthermore, the bearing blocks 3 and plate 2 of frame 1 may be constructed in the form of a molded monobloc part. Of course, in this case, there are no longer any stud bolts 9 and tenons 15 may be either formed by separate elements fixed to the molded monobloc part or formed integrally by molding with the molded monobloc part. Furthermore, instead of providing rollers 6 between the clamping blocks 5 and the bearing blocks 3, the clamping blocks 5 could be simply in sliding contact with the bearing blocks 3 or each clamping block 5 could be connected to the adjacent bearing block 3 by a series of links disposed parallel to each other. Furthermore, since bolts 12 removably fixing cover plate 8 to frame 1 are not subjected to transverse forces which, during clamping, are applied to the bearing blocks 3 of frame 1, they may be replaced by any other removable fixing means, such for example as quick opening and closure fastenings.

What is claimed is:

1. A traction block for a linear winch, comprising an elongated, hollow casing which is open at both ends thereof and which defines a passage adapted to receive an elongated section of an object on which a traction is to be exerted, and two wedge-shaped clamping blocks movably mounted in the passage of said casing for clamping said object, said casing comprising an elongated frame having a U-shaped cross section and having a flat web and two lateral spaced apart flanges perpendicular to the web, a flat cover plate parallel to the web of the frame, and fastening means for detachably securing said cover plate to said frame, said lateral flanges of said frame having inner plane surfaces converging toward one end of the passage of said casing, said clamping blocks having outer plane surfaces which face said inner surfaces of said lateral flanges, respectively, and which are parallel to said inner surfaces, respectively, whereby a longitudinal movement of said clamping blocks in relation to said lateral flanges in a first direction toward said one end of the passage of said casing causes said clamping blocks to clamp said object, and in a second direction opposite to said first direction causes said clamping blocks to release said object, said lateral flanges of said frame being subjected to high transverse reaction forces which tend to push said lateral flanges away from each other and which are transmitted to said cover plate when, in use, said clamping blocks are clamping said object, wherein said cover plate has an inner surface provided with two series of cavities aligned with the two lateral flanges of said frame, respectively, and wherein each of said lateral flanges has an end surface which faces said inner surface of said cover plate and which is provided with a series of tenons which are made by elements distinct from said fastening means and which are engaged and tightly fitted into the cavities of one of the two series of cavities of said cover plate, whereby said high transverse reaction forces are transmitted to said cover plate through said tenons, and said fastening means are substantially free from any stress due to said high transverse reaction forces.

2. The traction block as claimed in claim 1, wherein said tenons and said cavities of the cover plate are tapered, and the cover plate is pivotally mounted to one of the lateral flanges of said frame.

3. The traction block as claimed in claim 1, wherein the flat web of the frame is formed by a base plate and the lateral flanges of the frame are formed by two bearing blocks, said bearing blocks being fixed to said base plate of the frame by stud bolts which are distinct from said fastening means.

4. The traction block as claimed in claim 3, wherein said tenons are formed by head portions of the stud bolts fixing said bearing blocks to the base plate of the frame.

* * * * *